US009863293B2

(12) United States Patent
Pierik

(10) Patent No.: US 9,863,293 B2
(45) Date of Patent: Jan. 9, 2018

(54) VARIABLE VALVE ACTUATION SYSTEM INCLUDING AN ACCUMULATOR AND A METHOD FOR CONTROLLING THE VARIABLE VALVE ACTUATION SYSTEM

(75) Inventor: Ronald J. Pierik, Holly, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 724 days.

(21) Appl. No.: 13/564,111

(22) Filed: Aug. 1, 2012

(65) Prior Publication Data

US 2014/0034139 A1 Feb. 6, 2014

(51) Int. Cl.

| | |
|---|---|
| ***F01L 1/34*** | (2006.01) |
| ***F01L 9/02*** | (2006.01) |
| *F01L 1/344* | (2006.01) |

(52) U.S. Cl.

CPC ..... *F01L 9/02* (2013.01); *F01L 2001/34446* (2013.01); *Y10T 137/0324* (2015.04)

(58) Field of Classification Search

CPC ..... F01L 9/02; F01L 2001/34446; Y10T 137/0324

USPC ..... 123/90.12–90.13, 90.15–90.17, 90.19

See application file for complete search history.

(56) References Cited

U.S. PATENT DOCUMENTS

| | | | | |
|---|---|---|---|---|
| 3,926,159 | A | | 12/1975 | Michelson et al. |
| 4,106,446 | A | | 8/1978 | Yamada et al. |
| 4,174,687 | A | | 11/1979 | Fuhrmann |
| 4,188,925 | A | | 2/1980 | Jordan |
| 4,651,781 | A | | 3/1987 | Kandelman |
| 4,897,906 | A | | 2/1990 | Bartholomew |
| 5,209,453 | A | * | 5/1993 | Aota et al. ..... 251/57 |
| 5,617,827 | A | | 4/1997 | Eshleman et al. |
| 5,704,317 | A | * | 1/1998 | Barth ..... 123/90.17 |
| 5,709,248 | A | | 1/1998 | Goloff |
| 6,009,906 | A | | 1/2000 | Salazar |
| 6,035,819 | A | * | 3/2000 | Nakayoshi et al. ..... 123/90.17 |
| 6,053,136 | A | | 4/2000 | Albanello et al. |
| 6,109,304 | A | | 8/2000 | Wolf et al. |
| 6,148,798 | A | | 11/2000 | Braun et al. |
| 6,196,174 | B1 | * | 3/2001 | Wada et al. ..... 123/90.15 |
| 6,418,909 | B2 | | 7/2002 | Rossi et al. |
| 6,510,825 | B2 | | 1/2003 | Cristiani et al. |
| 6,513,500 | B2 | | 2/2003 | Braun et al. |
| 6,530,350 | B2 | | 3/2003 | Chiappini et al. |
| 6,755,162 | B1 | | 6/2004 | Marriott |
| 7,089,896 | B2 | * | 8/2006 | Diehl et al. ..... 123/90.12 |
| 2001/0023682 | A1 | * | 9/2001 | Cornell et al. ..... 123/446 |
| 2003/0015155 | A1 | | 1/2003 | Turner et al. |
| 2005/0022759 | A1 | * | 2/2005 | Panciroli ..... 123/90.12 |
| 2006/0027212 | A1 | * | 2/2006 | Gardner et al. ..... 123/458 |
| 2007/0277510 | A1 | * | 12/2007 | McClure et al. ..... 60/295 |

(Continued)

FOREIGN PATENT DOCUMENTS

| | | | |
|---|---|---|---|
| DE | 102008033766 A1 | * | 1/2010 |
| JP | 1113429 A | * | 1/1999 |
| WO | WO 2010054653 A1 | * | 5/2010 |

*Primary Examiner* — Zelalem Eshete

(57) ABSTRACT

A system according to the principles of the present disclosure includes a valve actuator, a pump, an accumulator, and a control valve. The valve actuator actuates at least one of an intake valve and an exhaust valve of an engine. The pump supplies hydraulic fluid to the valve actuator through a supply line. The accumulator stores hydraulic fluid. The control valve is disposed between the accumulator and the valve actuator.

22 Claims, 4 Drawing Sheets

(56) References Cited

U.S. PATENT DOCUMENTS

| | | | | |
|---|---|---|---|---|
| 2009/0071423 | A1* | 3/2009 | Sugihara | 123/90.15 |
| 2009/0206288 | A2* | 8/2009 | Schiemann | 251/129.01 |
| 2010/0313834 | A1* | 12/2010 | Auchter et al. | 123/90.15 |
| 2010/0326385 | A1* | 12/2010 | Busse | 123/90.17 |
| 2011/0290204 | A1* | 12/2011 | Kufner et al. | 123/90.12 |
| 2013/0118428 | A1* | 5/2013 | Suzuki et al. | 123/90.15 |
| 2013/0152572 | A1* | 6/2013 | Madderno et al. | 60/413 |

* cited by examiner

VARIABLE VALVE ACTUATION SYSTEM INCLUDING AN ACCUMULATOR AND A METHOD FOR CONTROLLING THE VARIABLE VALVE ACTUATION SYSTEM

FIELD

The present disclosure relates to a variable valve actuation system including an accumulator and a method for controlling the variable valve actuation system.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air/fuel mixture within cylinders to drive pistons, which produces drive torque. Air enters the cylinders through intake valves. Fuel may be mixed with the air before or after the air enters the cylinders. In spark-ignition engines, spark initiates combustion of the air/fuel mixture in the cylinders. In compression-ignition engines, compression in the cylinders combusts the air/fuel mixture in the cylinders. Exhaust exits the cylinders through exhaust valves.

A valve actuator actuates the intake and exhaust valves. The valve actuator may be driven by a camshaft. For example, the valve actuator may be a hydraulic lifter that is coupled to the camshaft using a pushrod or directly coupled to the camshaft. Alternatively, the valve actuator may actuate the intake and exhaust valves independent from a camshaft. For example, the valve actuator may be hydraulic, pneumatic, or electromechanical, and may be included in a camless engine or a camless valvetrain.

SUMMARY

A system according to the principles of the present disclosure includes a valve actuator, a pump, an accumulator, and a control valve. The valve actuator actuates at least one of an intake valve and an exhaust valve of an engine. The pump supplies hydraulic fluid to the valve actuator through a supply line. The accumulator stores hydraulic fluid. The control valve is disposed between the accumulator and the valve actuator.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
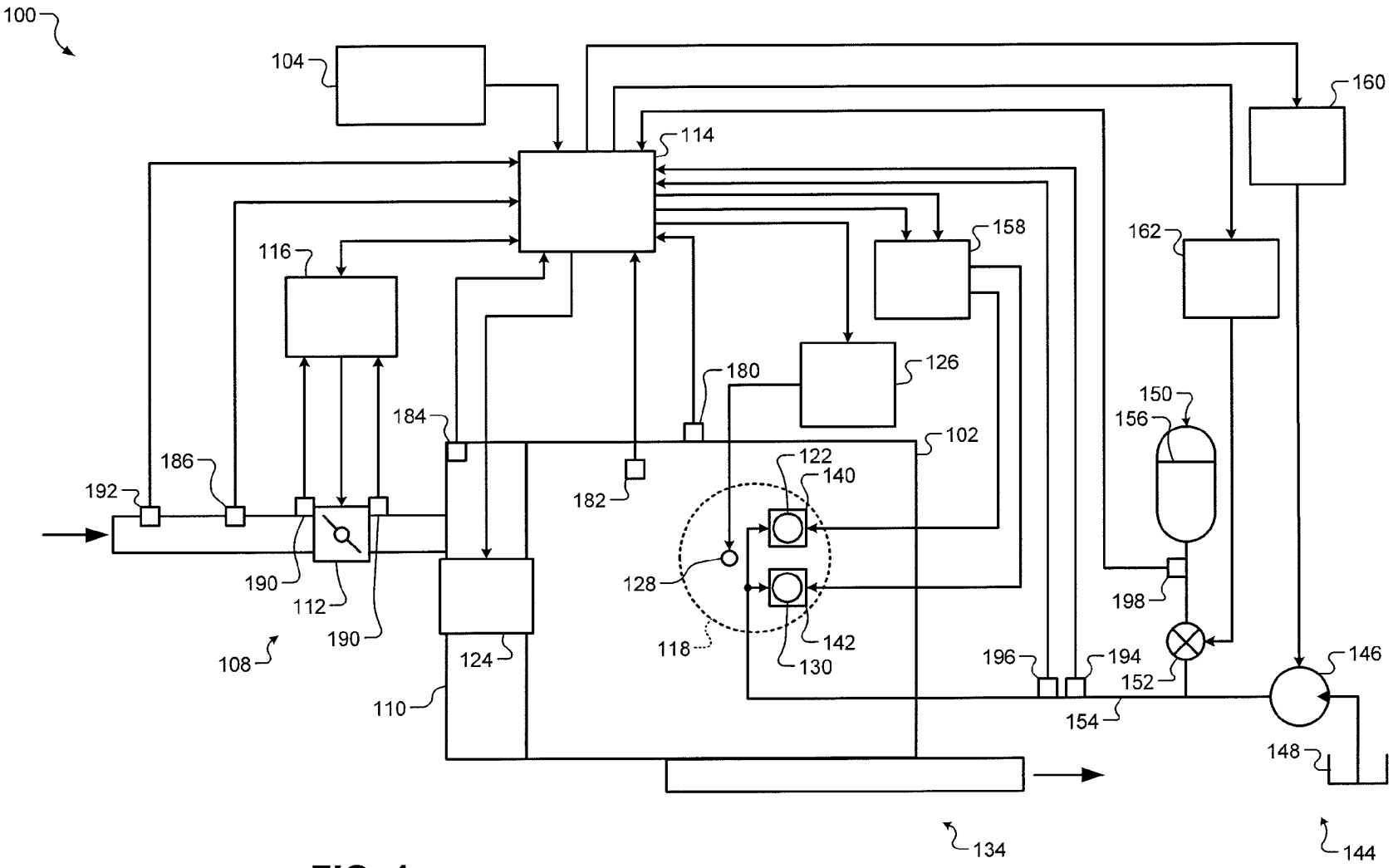
FIG. 1 is a functional block diagram of an example engine system according to the principles of the present disclosure.

A variable valve actuation system may include a valve actuator and a pump that pressurizes hydraulic fluid supplied to the valve actuator. The valve actuator may actuate an intake valve and/or an exhaust valve of an engine. The pump may be driven by the engine. Thus, the output of the pump may be reduced when the engine is starting compared to when the engine is running. In addition, when the engine is started shortly after the engine has been shut down, the engine may still be at a high temperature and therefore the viscosity of hydraulic fluid in the system may be low. As the viscosity decreases, it is easier for hydraulic fluid to leak through a clearance between a piston and cylinder in the pump. In addition, the period of each piston stroke may be longer due to the slower speed of the pump, increasing the period during which hydraulic fluid may leak through the clearance between the piston and the cylinder. Thus, the lower viscosity and the longer piston stroke period may increase the amount of leakage, decreasing an amount of hydraulic fluid that is output by the pump. As a result, the pressure of hydraulic fluid supplied to the valve actuator may be inadequate to enable the valve actuator to fully or even partially open the intake valve and/or the exhaust valve. This may increase engine cranking periods and engine emission levels.

A variable valve actuation system according to the principles of the present disclosure includes an accumulator that stores hydraulic fluid under pressure and a control valve disposed between the accumulator and a valve actuator. The control valve may be opened when an engine is starting (i.e., cranking) to assist a pump in pressurizing hydraulic fluid supplied to the valve actuator. When the control valve is opened while the pressure in the accumulator is greater than the pressure of hydraulic fluid supplied to the valve actuator, hydraulic fluid flows from the accumulator to the valve actuator. This increases the pressure of hydraulic fluid supplied to the valve actuator. In turn, the valve actuator is able to fully actuate an intake valve and/or an exhaust valve of an engine, even when the engine is started shortly after the engine has been shut down and the engine is still at a high temperature.

The control valve may also be opened when the engine is running to refill the accumulator with hydraulic fluid pressurized by the pump. When the control valve is opened while the pressure in the accumulator is less than the pressure of hydraulic fluid supplied to the valve actuator, hydraulic fluid flows from the pump to the accumulator. The accumulator may be refilled until the pressure in the accumulator is greater than a predetermined pressure.

Although hydraulic fluid from the accumulator may be used to pressurize hydraulic fluid supplied to the valve actuator when an engine is starting, there are other situations in which hydraulic fluid from the accumulator may be used. For example, hydraulic fluid from the accumulator may be used when the temperature of the engine is high after the engine is started. Hydraulic fluid from the accumulator may also be used under various engine operating conditions to improve fuel economy and/or performance (e.g., torque output). For example, hydraulic fluid from the accumulator may be used when the load on the engine is high such as during a hill climb, during sustained periods of high-speed operation, and/or during periods of high acceleration. In these situations, fuel economy and/or performance gains may be realized by disengaging the pump from the engine and pressurizing hydraulic fluid supplied to the valve actuator using only hydraulic fluid from the accumulator.

Referring now to FIG. 1, a functional block diagram of an engine system 100 is presented. The engine system 100 includes an engine 102 that combusts an air/fuel mixture to produce drive torque for a vehicle based on driver input from a driver input module 104. Air is drawn into the engine 102 through an intake system 108. For example only, the intake system 108 may include an intake manifold 110 and a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the spark actuator module 126 may vary the spark timing relative to TDC by the same amount for all of the cylinders in the engine 102.

During the combustion stroke, the combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

The intake valve 122 may be actuated using an intake valve actuator 140, while the exhaust valve 130 may be actuated using an exhaust valve actuator 142. In various implementations, the intake valve actuator 140 may actuate multiple intake valves (including the intake valve 122) for the cylinder 118. Similarly, the exhaust valve actuator 142 may actuate multiple exhaust valves (including the exhaust valve 130) for the cylinder 118. Additionally, a single valve actuator may actuate one or more exhaust valves for the cylinder 118 and one or more intake valves for the cylinder 118.

The intake valve actuator 140 and the exhaust valve actuator 142 actuate the intake valve 122 and the exhaust valve 130, respectively, independent from a camshaft. In this regard, the valve actuators 140, 142 may be part of a camless valvetrain and may be hydraulic, pneumatic, or electromechanical. As presently shown, the valve actuators 140, 142 are hydraulic, and a hydraulic system 144 supplies hydraulic fluid to the valve actuators 140, 142. A variable valve actuation system according to the principles of the present disclosure may include the ECM 114, the valve actuators 140, 142, and/or the hydraulic system 144.

The hydraulic system 144 includes a pump 146, a reservoir 148, an accumulator 150, and a control valve 152. The pump 146 supplies hydraulic fluid to the valve actuators 140, 142 through a supply line 154. The accumulator 150 stores hydraulic fluid under pressure. The control valve 152 may be opened to allow hydraulic fluid to flow between the accumulator 150 and the supply line 154. In various implementations, the supply line 154 may be omitted, in which case the pump 146 and the accumulator 150 may supply hydraulic fluid directly to the valve actuators 140, 142.

The pump 146 may be driven by the engine 102. For example, the pump 146 may be an axial piston pump that includes one or more pistons engaging a swash plate. The swash plate may be mounted on a shaft that is connected to the crankshaft of the engine 102 using a belt. The tilt angle of the swash plate relative to the shaft may be increased to increase the displacement of the pistons and thereby increase the output of the pump 146. The piston displacement may be zero when the tilt angle is zero.

The accumulator 150 contains compressed gas that pressurizes hydraulic fluid in the accumulator 150. Alternatively or additionally, the accumulator 150 may use a spring and/or a raised weight to pressurize hydraulic fluid in the accumulator 150. The accumulator 150 includes a membrane 156 that separates compressed gas in the accumulator 150 from hydraulic fluid in the accumulator 150.

A valve actuator module 158 controls the intake valve actuator 140 and the exhaust valve actuator 142 based on signals from the ECM 114. The valve actuator module 158 may control the intake valve actuator 140 to adjust the lift, duration, and/or timing of the intake valve 122. The valve actuator module 158 may control the exhaust valve actuator 142 to adjust the lift, duration, and/or timing of the exhaust valve 130.

A pump actuator module 160 controls the pump 146 based on signals from the ECM 114. The pump actuator module 160 may control the pump 146 to adjust the pressure of hydraulic fluid supplied to the valve actuators 140, 142. A valve actuator module 162 controls the control valve 152 based on signals from the ECM 114.

The engine system 100 may measure the position of the crankshaft using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown). The pressure within the intake manifold 110 may be measured using a manifold absolute pressure (MAP) sensor 184.

The mass flow rate of air flowing into the intake manifold 110 may be measured using a mass air flow (MAF) sensor 186. In various implementations, the MAF sensor 186 may be located in a housing that also includes the throttle valve 112. The position of the throttle valve 112 may be measured using one or more throttle position sensors (TPS) 190. The ambient temperature of air being drawn into the engine 102 may be measured using an intake air temperature (IAT) sensor 192.

The pressure of hydraulic fluid supplied to the valve actuators 140, 142 may be measured using a supply pressure (SP) sensor 194. The temperature of hydraulic fluid supplied to the valve actuators 140, 142 may be measured using a supply temperature (ST) sensor 196. The sensors 194, 196 may be located in the supply line 154 or the valve actuators 140, 142. The pressure of hydraulic fluid in the accumulator 150 may be measured using an accumulator pressure (AP) sensor 198. The ECM 114 may use signals from the sensors to make control decisions for the engine system 100.

Figure 2:
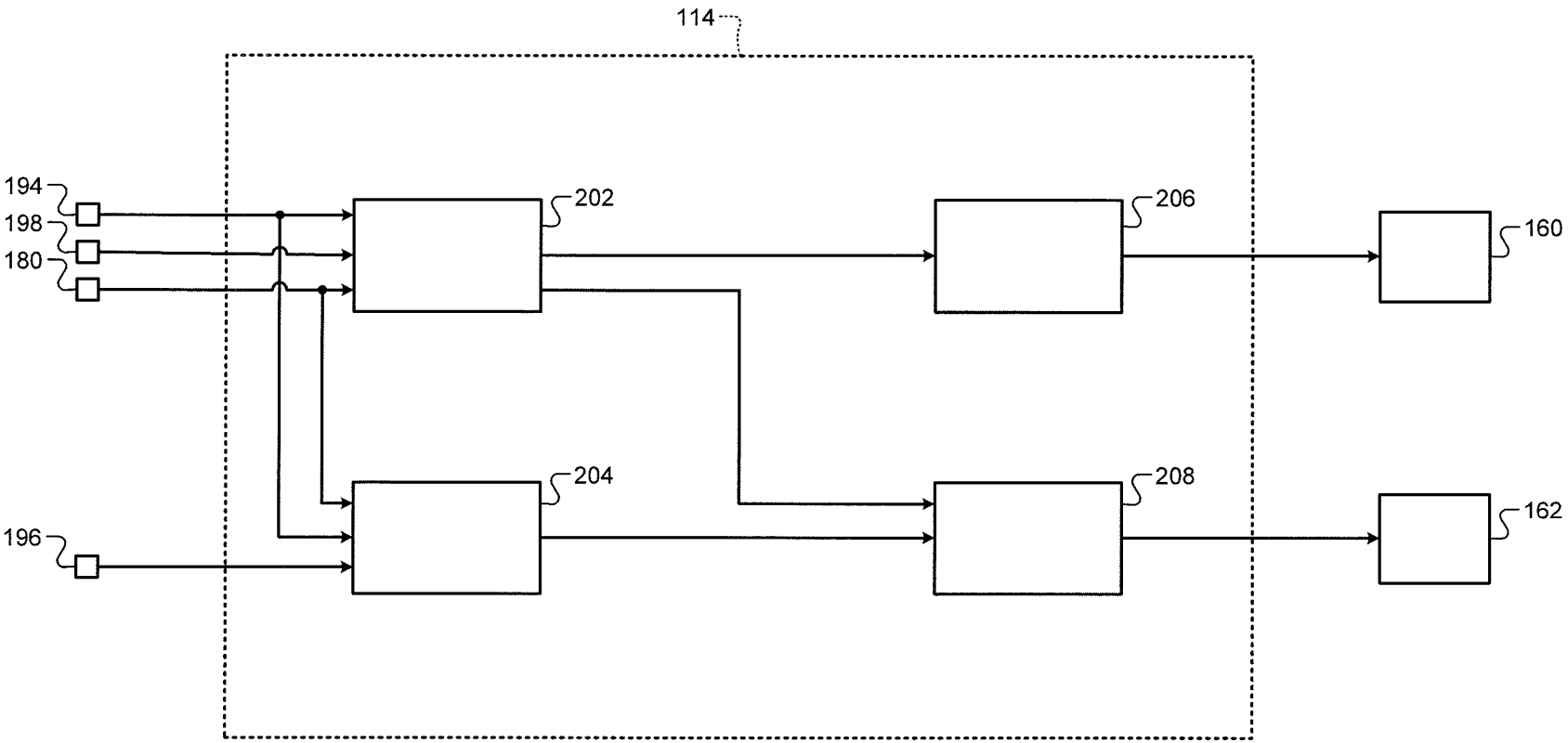
FIG. 2 is a functional block diagram of an example engine control system according to the principles of the present disclosure.

Referring now to FIG. 2, an example implementation of the ECM 114 includes an accumulator fill module 202, an accumulator drain module 204, a pump control module 206, and a valve control module 208. The accumulator fill module 202 may fill the accumulator 150 by instructing the pump control module 206 to increase the output of the pump 146 and/or instructing the valve control module 208 to open the control valve 152. The accumulator fill module 202 may fill the accumulator 150 based on the supply pressure from the SP sensor 194 and/or the accumulator pressure from the AP sensor 198.

The accumulator fill module 202 may fill the accumulator 150 while the engine 102 is running when the accumulator pressure is greater than a first pressure and the supply pressure is greater than the accumulator pressure. The first pressure may be a predetermined value (e.g., 500 pounds per square inch (psi)). The accumulator fill module 202 may determine when the engine 102 is running based on engine speed, which may be determined based on the crankshaft position from the CKP sensor 180. When the supply pressure is less than the accumulator pressure, the accumulator fill module 202 may instruct the pump control module 206 to increase the output of the pump 146 until the supply pressure is greater than the accumulator pressure.

The accumulator fill module 202 may stop filling the accumulator 150 when the accumulator pressure is greater than the first pressure. The accumulator fill module 202 may stop filling the accumulator 150 by instructing the pump control module 206 to decrease the output of the pump 146 to zero and/or instructing the valve control module 208 to close the control valve 152.

The accumulator drain module 204 drains the accumulator 150 to increase the pressure of hydraulic fluid supplied to the valve actuators 140, 142. The accumulator drain module 204 may drain the accumulator 150 by instructing the valve control module 208 to open the control valve 152. The accumulator drain module 204 may drain the accumulator 150 based on the supply temperature from the ST sensor 196 and/or the accumulator pressure.

The accumulator drain module 204 may drain the accumulator 150 while the engine 102 is starting when the supply temperature is greater than a first temperature and the accumulator pressure is greater than the first pressure. The first temperature may be within a predetermined range (e.g., between 120 degrees Celsius (° C.) and 150° C.). The accumulator fill module 202 may determine when the engine 102 is starting based on the engine speed.

The accumulator drain module 204 may stop draining the accumulator 150 when the supply temperature is less than the first temperature. The accumulator drain module 204 may stop draining the accumulator 150 by instructing the valve control module 208 to close the control valve 152.

The pump control module 206 adjusts the capacity of the pump 146 based on signals received from the modules 202, 204. The pump control module 206 adjusts the capacity of the pump 146 by outputting a signal to the pump actuator module 160. The valve control module 208 adjusts the control valve 152 based on signals received from the modules 202, 204. The valve control module 208 adjusts the control valve 152 by outputting a signal to the valve actuator module 162.

Figure 3:
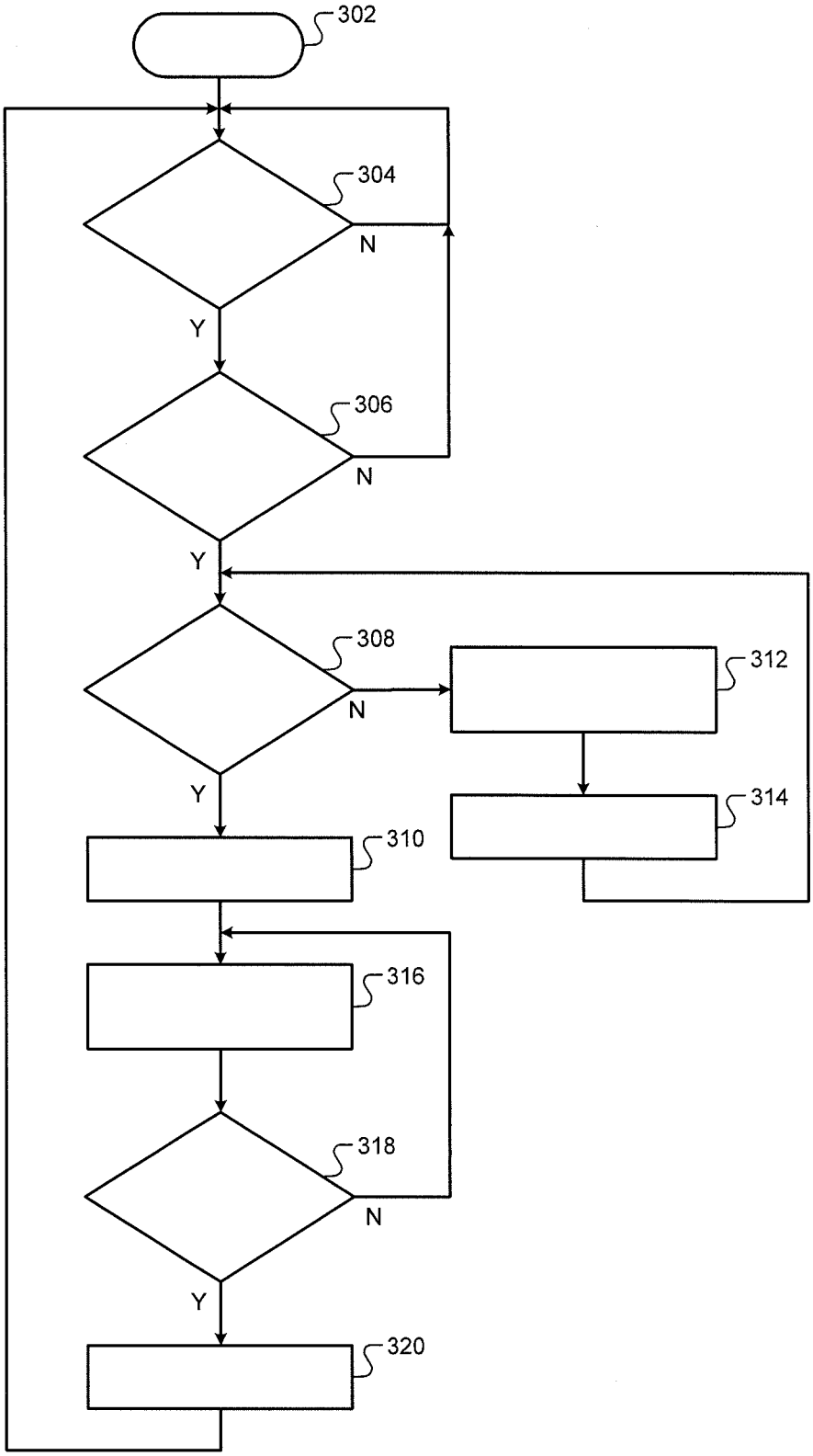
FIG. 3 is a first flowchart illustrating an example method for controlling a variable valve actuation system according to the principles of the present disclosure.

Referring now to FIG. 3, a method for refilling an accumulator while an engine is running begins at 302. At 304, the method determines whether the engine is running. The method may determine whether the engine is running based on engine speed, which may be determined based on crankshaft position. If the engine is running, the method continues to 306.

At 306, the method determines whether the pressure of hydraulic fluid in the accumulator is less than a first pressure. The first pressure may be a predetermined value (e.g., 500 psi). If the accumulator pressure is less than the first pressure, the method continues to 308. Otherwise, the method returns to 304.

At 308, the method determines whether the pressure of hydraulic fluid supplied to a valve actuator is greater than the accumulator pressure. If the supply pressure is greater than the accumulator pressure, the method continues to 310. Otherwise, the method continues to 312.

At 312, the method increases the supply pressure. The method may increase the supply pressure by operating a pump that pressurizes hydraulic fluid supplied to the valve actuator. At 314, the method waits for a first period and then returns to 308. The first period may be within a range (e.g., between 1 second and 10 seconds), which may be predetermined based on the flow rate of the pump and volume of the accumulator.

At 310, the method opens a control valve disposed between the pump and the accumulator to allow the pump to send hydraulic fluid into the accumulator. At 316, the method waits for a second period and then continues to 318. The second period may be within a predetermined range (e.g., between 1 second and 10 seconds).

At 318, the method determines whether the accumulator pressure is greater than the first pressure. If the accumulator pressure is greater than the first pressure, the method continues to 320. Otherwise, the method returns to 316. At 320, the method closes the control valve.

Figure 4:
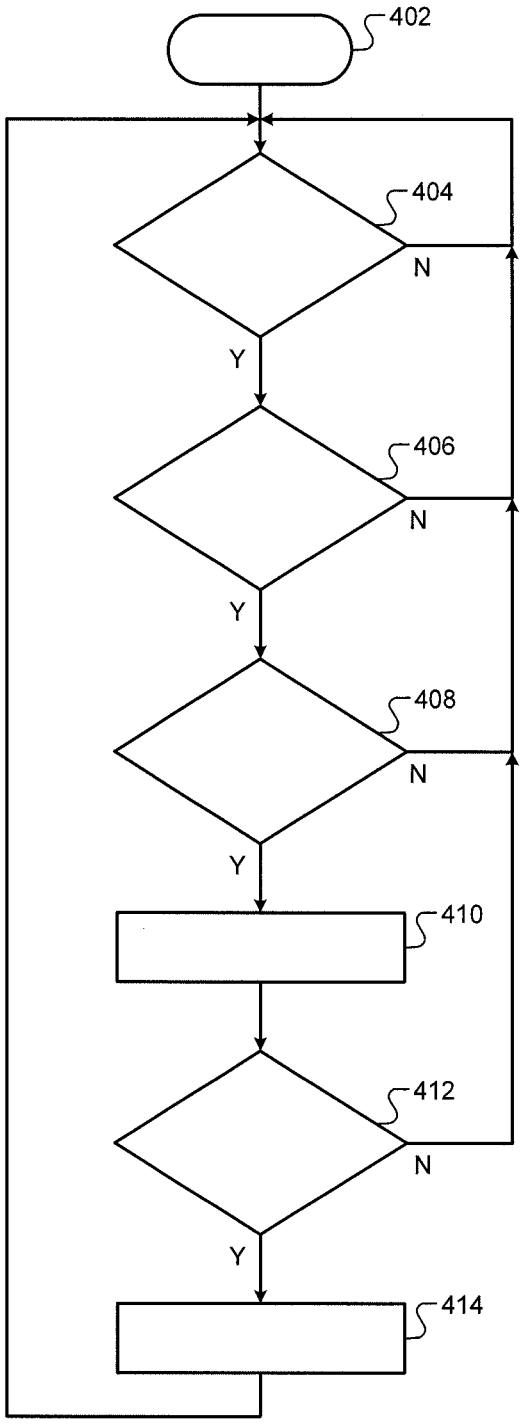
FIG. 4 is a second flowchart illustrating an example method for controlling a variable valve actuation system according to the principles of the present disclosure.

Referring now to FIG. 4, a method for increasing the pressure of hydraulic fluid supplied to a valve actuator of an engine while the engine is starting begins at 402. The method may determine whether the engine is starting based on engine speed, which may be determined based on crankshaft position. If the engine is starting, the method continues to 406.

At 406, the method determines whether the temperature of hydraulic fluid supplied to the valve actuator is greater than a first temperature. The first temperature may be within a predetermined range (e.g., between 120° C. and 150° C.). If the supply temperature is greater than the first temperature, the method continues to 408. Otherwise, the method returns to 404.

At 408, the method determines whether the pressure of hydraulic fluid in an accumulator is greater than a first pressure. The first pressure may be a predetermined value (e.g., 500 psi). If the accumulator pressure is greater than the first pressure, the method continues to 410. Otherwise, the method returns to 404.

At 410, the method opens a control valve to allow hydraulic fluid to flow from the accumulator to the valve actuator. At 412, the method determines whether the supply temperature is less than the first temperature. If the supply temperature is less than the first temperature, the method continues to 414. Otherwise, the method returns to 404. At 414, the method closes the control valve.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system comprising:

a valve actuator that actuates at least one of an intake valve and an exhaust valve of an engine;

a pump that supplies hydraulic fluid to the valve actuator through a supply line;

an accumulator that stores hydraulic fluid;

a control valve disposed between the accumulator and the valve actuator; and a valve control module configured to open the control valve in response to at least one of a first pressure of hydraulic fluid in the supply line and a second pressure of hydraulic fluid in the accumulator.

2. The system of claim 1, wherein the valve control module opens the control valve while the engine is running when the second pressure is less than a predetermined pressure and the first pressure is greater than the second pressure.

3. The system of claim 2, wherein the valve control module closes the control valve when the second pressure is greater than the predetermined pressure.

4. The system of claim 2, further comprising a pump control module that controls the pump to increase the first pressure when the second pressure is less than the predetermined pressure and the first pressure is less than the second pressure.

5. The system of claim 1, wherein the valve control module opens the control valve while the engine is starting when a temperature of hydraulic fluid supplied to the valve actuator is greater than a predetermined temperature and the second pressure is greater than a predetermined pressure.

6. The system of claim 5, wherein the valve control module closes the control valve when the temperature of hydraulic fluid supplied to the valve actuator is less than the predetermined temperature.

7. The system of claim 1, wherein the valve actuator actuates the at least one of the intake valve and the exhaust valve without using a camshaft.

8. The system of claim 1, wherein the pump is driven by the engine.

9. The system of claim 1, wherein the accumulator contains compressed gas in a membrane that pressurizes hydraulic fluid stored in the accumulator.

10. The system of claim 1, further comprising:

a first pressure sensor that measures the first pressure of hydraulic fluid in the supply line; and a second pressure sensor that measures the second pressure of hydraulic fluid in the accumulator.

11. The system of claim 1, wherein the valve control module opens the control valve based on a comparison of:

the at least one of the first pressure of hydraulic fluid in the supply line and the second pressure of hydraulic fluid in the accumulator; and a predetermined pressure.

12. A method comprising:

actuating at least one of an intake valve and an exhaust valve of an engine using a valve actuator;

supplying hydraulic fluid to the valve actuator through a supply line using a pump;

storing hydraulic fluid in an accumulator; and opening a control valve in response to at least one of a first pressure of hydraulic fluid in the supply line and a second pressure of hydraulic fluid in the accumulator, wherein the control valve is disposed between the accumulator and the valve actuator.

13. The method of claim 12, further comprising opening the control valve while the engine is running when the second pressure is less than a predetermined pressure and the first pressure is greater than the second pressure.

14. The method of claim 13, further comprising closing the control valve when the second pressure is greater than the predetermined pressure.

15. The method of claim 13, further comprising controlling the pump to increase the first pressure when the second pressure is less than the predetermined pressure and the first pressure is less than the second pressure.

16. The method of claim 12, further comprising opening the control valve while the engine is starting when a temperature of hydraulic fluid supplied to the valve actuator is greater than a predetermined temperature and the second pressure is greater than a predetermined pressure.

17. The method of claim 16, further comprising closing the control valve when the temperature of hydraulic fluid supplied to the valve actuator is less than the predetermined temperature.

18. The method of claim 12, wherein the valve actuator actuates the at least one of the intake valve and the exhaust valve without using a camshaft.

19. The method of claim 12, wherein the pump is driven by the engine.

20. The method of claim 12, wherein the accumulator contains compressed gas in a membrane that pressurizes hydraulic fluid stored in the accumulator.

21. The method of claim 12, further comprising:

measuring the first pressure of hydraulic fluid in the supply line; and measuring the second pressure of hydraulic fluid in the accumulator.

22. The method of claim 12, further comprising opening the control valve based on a comparison of:

the at least one of the first pressure of hydraulic fluid in the supply line and the second pressure of hydraulic fluid in the accumulator; and a predetermined pressure.

* * * * *